US005820493A

United States Patent [19]

Price, Jr.

[11] Patent Number: 5,820,493

[45] Date of Patent: Oct. 13, 1998

[54] FOOT POSITIONING AND CLUB ALIGNING METHOD FOR GOLFERS

[76] Inventor: John D. Price, Jr., 37 Inglesid La., Liverpool, N.Y. 13090

[21] Appl. No.: 856,521

[22] Filed: May 14, 1997

[51] Int. Cl.[6] ..... A63B 69/36

[52] U.S. Cl. ..... 473/409; 473/272; 473/273

[58] Field of Search ..... 473/218, 270, 473/272, 273, 409

[56] References Cited

U.S. PATENT DOCUMENTS

| | | | |
|---|---|---|---|
| 1,208,995 | 12/1916 | Lyon . | |
| 2,941,808 | 6/1960 | Smith et al. | 273/187 |
| 3,166,327 | 1/1965 | Champion | 473/218 X |
| 3,229,981 | 1/1966 | Taber | 273/187 |
| 3,343,268 | 9/1967 | Schennum | 33/174 |
| 3,580,584 | 5/1971 | Trosko | 273/186 |
| 4,101,130 | 7/1978 | Richards | 273/187 |
| 4,257,608 | 3/1981 | Funk | 273/187 |
| 4,478,422 | 10/1984 | Blanchard | 273/187 |
| 4,544,159 | 10/1985 | Sells | 273/183 |
| 4,805,913 | 2/1989 | Bott | 273/187 |
| 5,437,448 | 8/1995 | Balson | 273/187 |
| 5,544,886 | 8/1996 | Van Skiver | 473/147 |
| 5,590,882 | 1/1997 | Todd | 473/218 |
| 5,599,240 | 2/1997 | Feldmeier | 473/218 |

*Primary Examiner*—George J. Marlo
*Attorney, Agent, or Firm*—George R. McGuire

[57] ABSTRACT

A golf aid for use by a golfer to improve ball addressing and shot aligning techniques. The aid is generally comprised of an elongated cord having opposite first and second ends, a pin and a ring fixedly secured to the first and second ends, respectively, and a back foot position indicator embodied in the form of a cord engaging clamp mounted for slidable movement along the length of the cord. In use, a golfer would first analyze a shot to determine the best direction for the ball to travel. Following the shot analysis, the golfer would then take the pin attached to the cord's first end and insert it into the ground adjacent the rear of the golf ball. The cord could then be pulled taut and positioned on the ground in a line approximating the line in which it is desired for the ball to travel. The cord engaging clamp may then be adjusted to the position along the length of the cord that will be laterally aligned with the appropriate position for the back foot.

5 Claims, 3 Drawing Sheets

FOOT POSITIONING AND CLUB ALIGNING METHOD FOR GOLFERS

BACKGROUND OF THE INVENTION

The present invention generally relates to instructional golf aids, and more particularly to golf aids which teach and improve a golfer's foot positioning and club alignment techniques.

In skillfully playing the game of golf, it is desirable to control the trajectory of the ball to a very high degree. For instance, it is often times necessary to cause the ball to curve a certain amount to the right or left while in flight in order to avoid certain obstacles and hazards, or to have the ball spin backwards upon hitting the ground. The principal elements within a golfer's control to affect the ball's trajectory are the golfer's stance and swing.

The first thing a golfer must do after analyzing how he wants the ball to travel and respond is to appropriately address the ball. Depending on the type of shot to be hit, i.e., a slice, hook, fade or draw, the golfer's feet must be properly spaced from each other, as well as from the ball. In addition, for the majority of golf shots, it is proper for the golfer's front foot to be laterally aligned with or positioned in front of the ball and for the back foot to be positioned a certain distance behind the ball.

After determining the proper foot spacing and positioning, a golfer must then align his body such that the ball will travel in the intended direction. To accomplish this, a golfer must figure out the best line for the ball to follow, and then stand essentially parallel to that line, thereby resulting in the proper alignment of the club face to the ball. Upon a golfer properly spacing and positioning his feet and standing parallel to the desired travel line, a properly executed swing will result in the ball landing at its intended destination.

A variety of patented devices have been invented to aid golfers in properly addressing the ball and properly aligning the club face with the ball. Examples of such devices are exemplified in U.S. Pat. Nos. 3,229,981 to Taber; 5,590,882 to Todd; 1,208,995 to Lyon; and 4,805,913 to Bott. While these and other prior art golf aids are useful and do achieve their stated objectives, most, if not all of them, are very bulky to carry around a golf course or complicated to use. Moreover, the prior art devices tend to offer a golfer so many things to think about, that they actually distract from the concentration necessary for a golfer to effectively swing the club.

It is therefore a primary object of the present invention to provide an effective golf aid which is simple to use and compact enough to be easily carried around a golf course.

It is a further object of the present invention to provide a golf aid that is easy and inexpensive to manufacture.

It is an additional object of the present invention to provide a golf aid that may be effectively used on either a golf course or a driving range mat.

It is yet another object of the present invention to provide a golf aid that assists golfers in improving certain aspects of their game without distracting them from concentrating on their swing.

Other objects and advantages of the present invention will in part be obvious, and in part appear hereinafter.

SUMMARY OF THE INVENTION

In accordance with the foregoing objects and advantages, the present invention is generally comprised of an elongated, flexible cord that may be securely positioned on the ground behind a golf ball and in a line approximating the desired travel line of the ball. The first end of the cord includes a pin fixedly secured thereto, while the cord's second end includes a ring attached thereto. In addition, a back foot position indicator is slidably adjustable along the cord's length.

The pin attached to the cord's first end may be inserted into the ground directly behind a golf ball. The user may then place a finger through the ring and pull the cord tautly, lining up the cord with the desired travel line of the ball.

Once the cord is properly lined up, the user may then adjust the back foot position indicator to the position along the length of the cord appropriate for the shot. After adjusting the foot position indicator to the appropriate position behind the ball, the user may then address the ball and prepare to swing the club and hit the ball.

In addressing the ball, the user should stand a predetermined distance from the ball with his body parallel to the cord, and with his front foot laterally aligned with or positioned in front of the ball and his rear foot aligned with the back foot position indicator. The club face should then be set on the cord slightly behind the ball, and the user can reposition his body until the club face lies perpendicular to the cord. As the user takes his backswing, the club should slowly follow the line of the cord in order to ensure proper club alignment. A proper follow through on the swing will then result in the ball traveling along the desired trajectory.

On tee shots or when practicing on a driving range mat having a permanent rubber tee, the user may place the ring circumferentially around the tee and pull the cord taut. The aid may then be used in the same manner as when positioning the pin adjacently behind the ball.

DETAILED DESCRIPTION

Figures 1, 4:
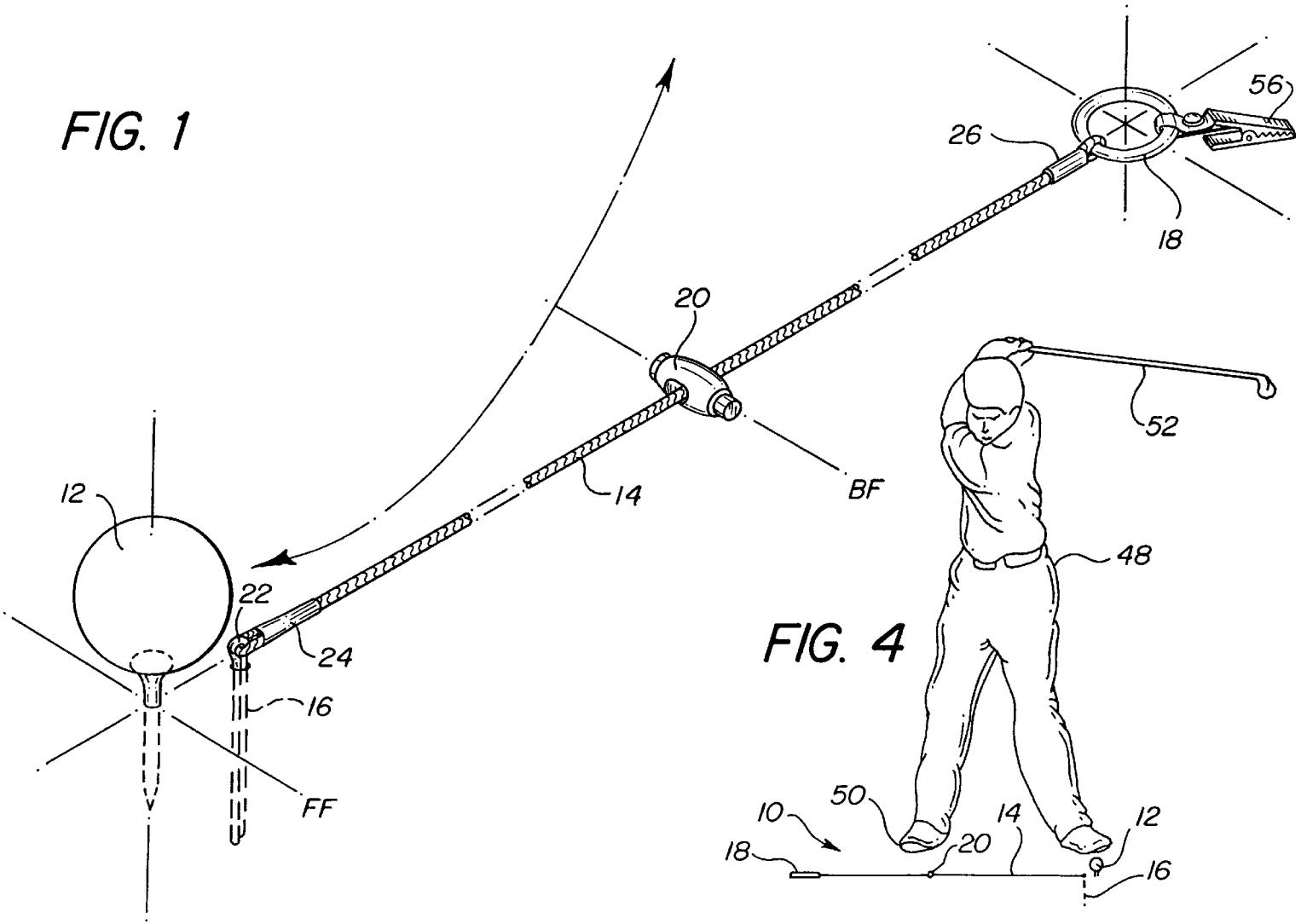
FIG. 1 is a perspective view of the present invention showing one manner of using the golf aid device.
FIG. 4 is a side elevational view showing a golfer using the golf aid.
Figure 1A:
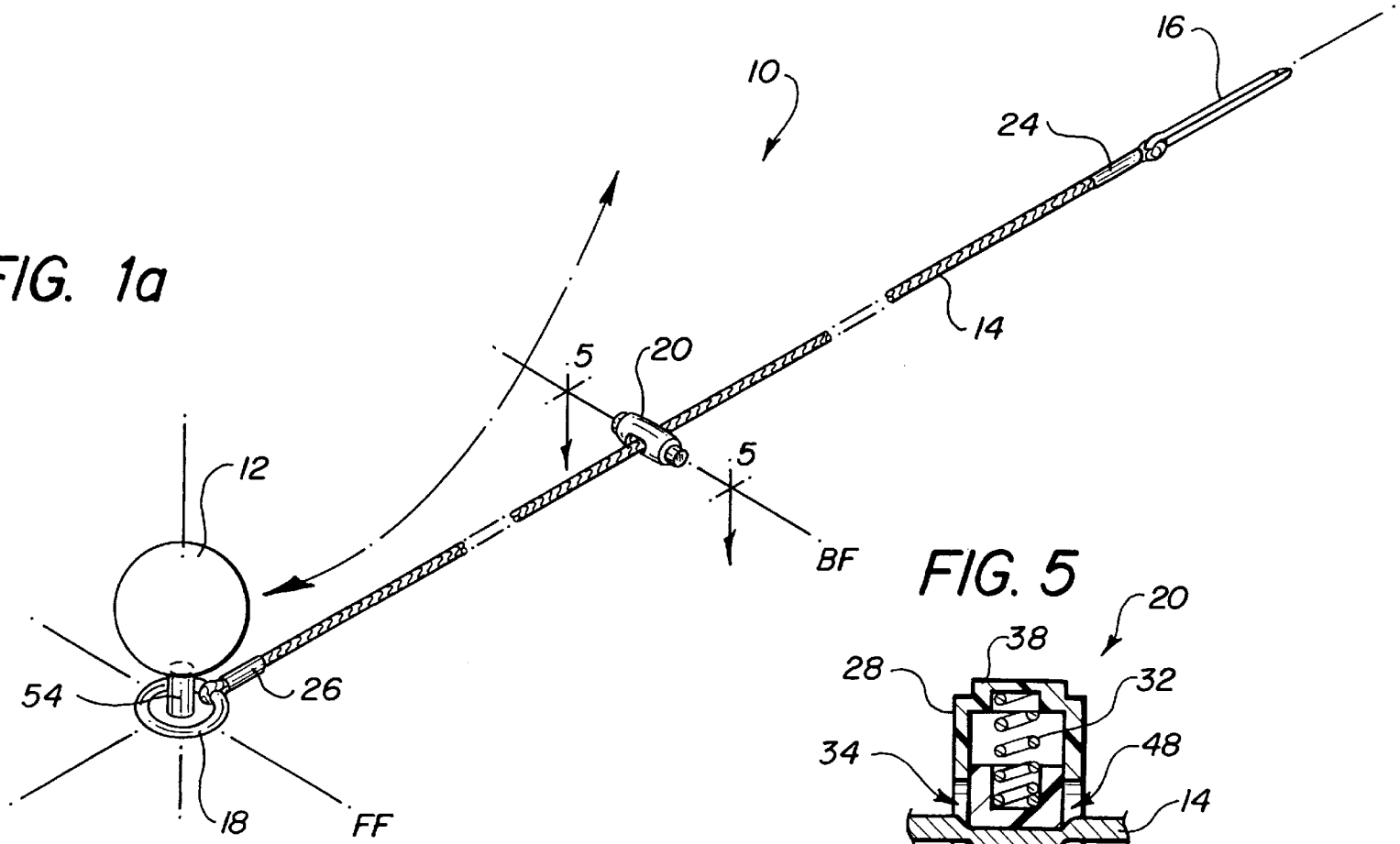
FIG. 1*a* is a perspective view of showing an alternate way of using the present golf aid.

Referring now to the accompanying drawings, wherein like reference numerals refer to like parts throughout, there is seen in FIGS. 1 and 1*a* a golf aid device, denoted generally by reference numeral 10, which is intended to be placed on the ground in close proximity to the rear face of a golf ball 12 and extend in an essentially straight line away from the ball. Golf aid 10 is generally comprised of an elongated, flexible cord 14 having a pin 16 and a ring 18 securely attached to its first and second opposite, terminal ends, respectively, and a back foot position indicator embodied in the form of a cord engaging clamp 20 which is mounted for slidable movement along the length of cord 14.

Pin 16 and ring 18 are securely attached to the opposite ends of cord 14 by the cord's ends passing through pin head 22 and ring 18, respectively, and being doubled back over cord 14 where rubber or plastic sleeves 24 and 26, respectively, are placed over the ends to gather and maintain them in position. Preferably, sleeves 24 and 26 are composed of a heat-shrink rubber or plastic, whereby after they are placed over the cord's ends they may be heated to a predetermined temperature at which they will shrink and hence, become more tightly wrapped around cord 14, thereby securely maintaining pin 16 and ring 18 in attached relation to cord 14.

Figure 5:
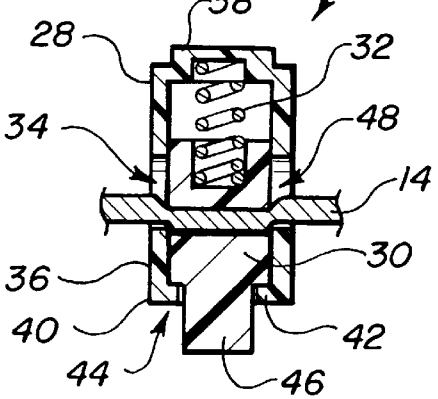
FIG. 5 is a cross-sectional view of the cord engaging clamp taken along line 5—5 of FIG. 1.
Figure 2:
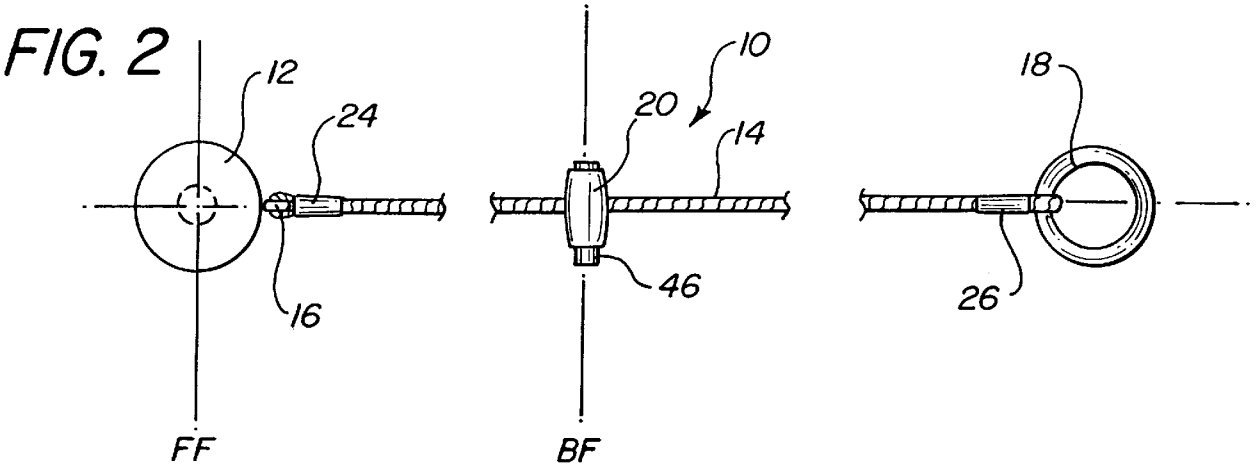
FIG. 2 is a top plan view of the golf aid.
Figure 3:
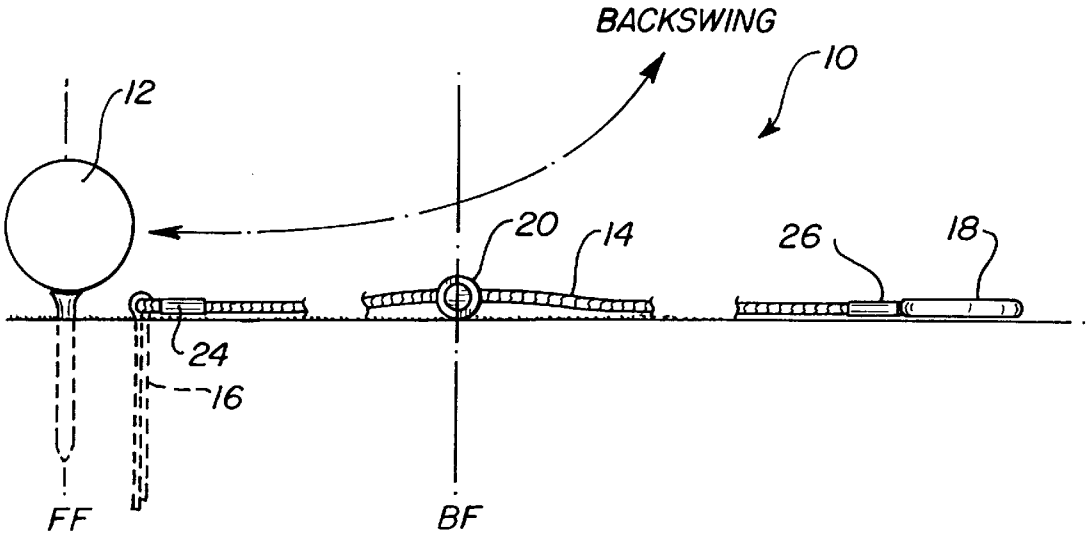
FIG. 3 is a side elevational view of the golf aid.

In the manufacturing of golf aid 10, cord clamp 20 would be placed onto cord 14 prior to pin 16 and ring 20 being attached thereto. Referring particularly to FIG. 5, cord clamp 20 is seen to be essentially comprised of a cylindrically elongated body portion 28, an elongated piston 30 positioned for longitudinal, sliding movement within body 28, and a spring 32 positioned within body 28 and in biased, contacting relation to piston 30. Body 28 includes a pair of axially aligned holes 34 formed through its sidewall 36, a closed bottom end 38, and a top end 40 having a shoulder region 42 which defines an opening 44 formed centrally through top end 40. Spring 32 is seated with one end on bottom end 38 and with its other end urging piston 30 into contacting relation with shoulder region 42. Piston 30 includes a push button 46 which extends through opening 44 so as to be accessible to a user of golf aid 10, as well as a pair of axially aligned holes 48 formed through its sidewalls. Clamp 20 is mounted on cord 14 such that the cord extends through each set of holes 34 and 48. With clamp 20 in its natural, unaffected state, spring 32 urges piston 30 into contacting relation with shoulder region 42 and causes the sets of holes 34 and 48 to be axially displaced from one another, thereby crimping cord 14 between body 28 and piston 30 and preventing sliding movement of clamp 20 along cord 14.

In order to adjust the position of clamp 20 along the length of cord 14, it is necessary for a user of golf aid 10 to manually depress push button 46 causing spring 32 to compress and holes 34 and 48 to all become axially aligned. Once button 46 is depressed, there are no forces restricting the sliding movement of clamp 20 along cord 14, and clamp 20 can be adjusted to a desired position. Once button 46 is released, spring 32 urges piston 30 against shoulder region 42 causing holes 34 and 48 to become axially displaced and cord 14 to become crimped.

In use, a golfer 48 (see FIG. 4) would determine where and how he wants golf ball 12 to travel. Once that is determined, golfer 38 may take golf aid 10 and insert pin 16 into the ground directly behind golf ball 12. Ring 18 may then be grasped and cord 14 pulled taut and laid on the ground in an essentially straight line approximating the line in which it is desired to hit golf ball 12. Button 36 may then be depressed, and clamp 20 slid to the position along the length of cord 14 which is laterally aligned with the proper position for the golfer's back foot (BF) 50 when addressing the ball. After golfer 48 has positioned himself an appropriate distance from ball 12, he should align his body essentially parallel to cord 14, and place his back foot 50 in laterally aligned relation to cord clamp 20. To verify that his body is properly positioned, golfer 48 should then set the face of club 52 on cord 14 directly behind ball 12 and readjust his body position until the club head is perpendicular to the cord.

This proper body positioning will ensure that the ball will travel in the line indicated by cord 14 so long as golf club 52 is properly swung, and ball 12 is properly struck. Golf aid 10 also assists golfer 48 in executing a proper swing by having him take his backswing in a path following the line formed by cord 14. By concentrating on following this line, the golfer's backswing should be slower than if done without golf aid 10. A slower backswing typically results in a swing with the best possible form regardless of the particular golfer. Thus, golf aid 10 improves a golfer's ball addressing and shot aligning techniques, as well as his swing.

If golf aid 10 is being used on a conventional driving range mat, as opposed to natural grass, ring 18 may be placed over the rubber tee 54 (FIG. 1*a*) which extends upwardly from the mat. Cord 14 may then be pulled taut and aligned in the same manner as when using golf aid 10 on natural grass.

In order to make golf aid 10 easier to carry around a golf course and used on each shot, a clip 56 is attached to ring 18 by any conventional fastener. Clip 56 permits golf aid 10 to be easily and quickly attached and detached to a golf bag or golf towel, thereby making it easy and convenient for a golfer to carry golf aid 10 around a golf course.

What is claimed is:

1. A method for using a ground engaging golf aid to effect hitting a golf ball in a predetermined travel line which intersects said golf ball, said method consisting essentially of the steps of:

a) securing a first end of a flexible cord having first and second opposite ends to said ground with said first end being positioned adjacent to said golf ball;

b) extending and lying said cord upon said ground along said predetermined travel line; and c) sliding a foot position indicator to a predetermined position along said cord.

2. The method as recited in claim 1, wherein the step of securing the first end of a flexible cord includes inserting a pin fixedly attached to said first end into said ground, adjacent to said golf ball.

3. The method as recited in claim 1, wherein the step of securing the first end of a flexible cord includes placing a ring fixedly attached to said first end circumferentially around a golf tee on which said golf ball sits.

4. The method as recited in claim 3, and further consisting essentially of the following steps:

d) removing said flexible cord from upon said ground; and e) attaching said flexible cord to a golf bag.

5. The method as recited in claim 4, wherein the step of attaching said flexible cord to said golf bag includes actuating a clip fixedly attached to said ring to securely engage said golf bag.

* * * * *